US005381665A

United States Patent [19]

Tanaka

[11] Patent Number: 5,381,665

[45] Date of Patent: Jan. 17, 1995

[54] REFRIGERATING SYSTEM WITH COMPRESSOR COOLED BY LIQUID REFRIGERANT

[75] Inventor: Tsutomu Tanaka, Ohta, Japan

[73] Assignee: Sanyo Electric Co., Ltd., Moriguchi, Japan

[21] Appl. No.: 164,633

[22] Filed: Dec. 7, 1993

Related U.S. Application Data

[63] Continuation of Ser. No. 918,284, Jul. 22, 1992, abandoned.

[30] Foreign Application Priority Data

Aug. 30, 1991 [JP] Japan ..... 3-220355

[51] Int. Cl.[6] ..... F25D 21/00

[52] U.S. Cl. ..... 62/197; 62/278; 62/509

[58] Field of Search ..... 62/278, 196.3, 196.4, 62/197, 505, 509, 81

[56] References Cited

U.S. PATENT DOCUMENTS 3,427,819 2/1969 Seghetti ..... 62/278 X
3,580,006 5/1971 Quick ..... 62/278 X
4,167,102 9/1979 Willitts ..... 62/509 X
4,621,505 11/1986 Ares et al. ..... 62/509
4,979,371 12/1990 Larson ..... 62/278 X

*Primary Examiner*—Harry B. Tanner
*Attorney, Agent, or Firm*—Darby & Darby

[57] ABSTRACT

The present invention aims at providing a refrigerating system capable of cooling a compressor stably using a liquid injection circuit even when defrosting of an evaporator is performed using a gaseous refrigerant of high pressure. The refrigerating system comprises a compressor having a refrigerant discharge side and a refrigerant suction side; a condenser connected to the discharge side of the compressor; a receiver tank connected to a refrigerant outlet side of the condenser; an evaporator connected between a refrigerant outlet side of the receiver tank and the suction side of the compressor; a defrosting circuit which supplies a gaseous refrigerant obtained by gas-liquid separation in the receiver tank to the evaporator to defrost the evaporator; and a liquid injection circuit which supplies a liquid refrigerant obtained by gas-liquid separation in the receiver tank to a low pressure side in the interior of the compressor.

8 Claims, 5 Drawing Sheets

REFRIGERATING SYSTEM WITH COMPRESSOR COOLED BY LIQUID REFRIGERANT

This is a continuation application Ser. No. 07/918,284, filed Jul. 22, 1992, abandoned.

BACKGROUND OF THE INVENTION

1. Field of the Invention

The present invention relates to a refrigerating system which supplies a gaseous refrigerant of high pressure to an evaporator to defrost the evaporator and also supplies a liquid refrigerant to a low pressure side of the interior of a compressor through a liquid injection circuit to effect cooling of the compressor.

2. Description of the Prior Art

Heretofore, in a showcase for refrigeration and cold storage mounted as a food refrigerating and cold storage equipment in a supermarket or the like, there has been adopted a method of using a high-pressure gas refrigerant discharged from a compressor, for defrosting an evaporator as a constituent of the refrigerator. There also has been adopted a so-called liquid injection method in which a liquid refrigerant is fed to the interior of a compressor and is allowed to evaporate therein to cool the compressor for the purpose of preventing the increase of the temperature of gas discharged from the compressor.

FIGS. 3 to 5 are refrigerant circuit diagrams in conventional refrigerating systems of this type. FIG. 3 illustrates a refrigerating system of the type in which a refrigerant is condensed by cooling with air, and a gaseous refrigerant of high pressure discharged from a compressor during defrosting is allowed to flow directly through an evaporator. FIG. 4 illustrates a refrigerating system of the type in which a refrigerant is condensed by cooling with water, and like FIG. 3, a gaseous refrigerant of high pressure discharged from a compressor is allowed to flow directly through an evaporator during defrosting. FIG. 5 illustrates a refrigerating system of the type in which a refrigerant is condensed by cooling with air, and the refrigerant in a gas-liquid mixed state leaving a condenser during defrosting is allowed to flow into an evaporator. In these figures, the portions indicated by the same reference numerals represent the same portions.

Referring first to FIG. 3, a discharge-side pipe 2 is connected to a refrigerant discharge side 1D of a compressor constituted by a scroll compressor or a semi-sealed type compressor, and it is also connected at an opposite end thereof to a refrigerant inlet side 3A of an air-cooled condenser 3. To a refrigerant outlet side 3B of the condenser 3 is connected an outlet-side pipe 4, which is connected at an opposite end thereof to a refrigerant inlet side 5A of a receiver tank 5. To a refrigerant outlet side 5B of the receiver tank 5 is connected an outlet-side pipe 6, to which are connected in series a drier 7, a sight glass 8, a valve 9, and solenoid valves 10, 11. The solenoid valve 11 is connected to an evaporator 13 through an expansion valve 12.

The evaporator 13 is mounted in an inner cold air passage of a showcase for refrigeration and cold a storage (not shown), and an outlet side of the evaporator 13 is connected to an accumulator 16 through a solenoid valve 14 and further through a low pressure-side pipe 15. A solenoid valve 18 is disposed in a by-pass pipe 17 which by-passes the solenoid valve 11 and the expansion valve 12, and a pipe 19 branching from between the solenoid valve 11 and the expansion valve 12 is connected to an evaporator 22 through a solenoid valve 20 and an expansion valve 21. The evaporator 22 is mounted in an outer cold air passage of the showcase for refrigeration and cold storage, and an outlet side thereof is connected to low pressure-side pipe 15. A pipe 24 branching from between the evaporator 13 and the solenoid valve 14 is connected to an inlet side of the solenoid valve 20 through a check valve 25. Further, a suction-side pipe 26 connected to an outlet side of the accumulator 16 is connected in an opposite end thereof to a suction side 1S of the compressor 1.

A liquid injection circuit 27 branches from the outlet-side pipe 6 of the receiver tank 5 and is connected to a liquid injection inlet 1R on a low pressure side in the compressor 1 through a capillary tube 28 and a solenoid valve 29. A defrosting pipe 30 branching from the discharge-side pipe 2 of the compressor 1 is connected to an outlet side of the solenoid valve 10 through a solenoid valve 31. Further, a pipe 32 branched from the discharge-side pipe 2 is connected to the low pressure-side pipe 15 through a solenoid valve 33 and a low-pressure regulating valve 34.

The operation of the refrigerating system shown in FIG. 3 will now be described. During normal cooling operation using the evaporator 13, the solenoid valves 10, 11, 14 and 29 are open, while the other solenoid valves are closed. The gaseous refrigerant of high temperature and high pressure discharged from the compressor 1 radiates heat and condenses in the condenser 3, then the refrigerant, which is now in a gas-liquid mixed state, flows into the receiver tank 5, in which the refrigerant is separated into gas and liquid. The liquid refrigerant, present in the lower portion, flows out from the outlet side 5A, passes through the outlet-side pipe 6, further passes through the solenoid valves 10 and 11, then is throttled by the expansion valve 12 and thereafter enters the evaporator 13, as indicated by solid-line arrows in the figure. The refrigerant evaporates in the evaporator 13, then passes through the solenoid valve 14, further through the low pressure-side pipe 15, and enters the accumulator 16, in which unevaporated liquid refrigerant is separated. Only the gaseous refrigerant is introduced into the compressor 1.

After such cooling operation has been done for a predetermined period of time (e.g. 3 hours), there is performed a defrosting operation for the evaporator 13. However, prior to starting the defrosting operation, the solenoid valve 20 is opened to a greater extent than the foregoing state thereof only for a predetermined short period (e.g. 30 seconds), thereby allowing the refrigerant which has been throttled by the expansion valve 21 to allow also into the evaporator 22 for evaporation therein, as indicated by broken-line arrows in the figure. Thus, the interior of the showcase is cooled by both evaporators 13 and 22 which are for the inner and outer cold air passages, respectively. After completion of this cooling operation, the solenoid valves 31, 18, 20, 29 and 33 are opened, while the other solenoid valves are closed. As a result, the gaseous refrigerant of high temperature and high pressure discharged from the compressor 1 passes through the defrosting pipe 30, further through the solenoid valves 31 and 18, while by-passing the expansion valve 12 through the by-pass pipe 17, and enters the evaporator 13, as indicated by broken-line arrows in the figure. Consequently, the evaporator 13 is heated and defrosted. At the same time, the refrigerant condensed in the interior passes through the pipe 24, further through the check valve 25 and the solenoid valve 20, then is throttled in the expansion valve 21, thereafter flows into the evaporator 22 and is evaporated therein. Thus, even during defrosting of the evaporator 13, the interior of the showcase can be cooled by the evaporator 22. The refrigerant evaporated in the evaporator 22 returns to the accumulator 16 in the same manner as described above. During defrosting, moreover, the gaseous refrigerant of high temperature and high pressure discharged from the compressor 1 passes through the solenoid valve 33 and the low-pressure regulating valve 34 and flows into the suction-side pipe 15 to prevent the low pressure-side pressure of the compressor 1 from dropping too much.

A defrosting end temperature of the evaporator 13 is sensed by a sensor (not shown), and when the defrosting of the evaporator 13 is completed, only the solenoid valves 20 and 29 are opened for a predetermined period (e.g. 3 minutes), while the other solenoid valves are closed, whereby there is performed an operation for recovering the refrigerant present in each of both evaporators 13 and 22.

Since the solenoid valve 29 is kept open over each of the above operation periods, the liquid refrigerant staying in the receiver tank flows through the liquid injection circuit 27, then is throttled by the capillary tube 28 and enters the compressor 1, where it is evaporated and cools the compressor 1 to cool the oil, compressed refrigerant, motor core and the other parts in the compressor 1.

In the refrigerating system shown in FIG. 4, the foregoing condenser 3 is not present, and a discharge-side pipe 2 connected to a discharge side 1D of the compressor 1 is connected in an opposite end thereof to a refrigerant inlet side 5A of a receiver tank 5 through a drier 36. On the other hand, a water-cooling pipe 37 through which cooling water flows is drawn into the receiver tank 5. The refrigerant present in the receiver tank 5 is cooled and condensed by the water-cooling pipe 37. The flow of water into the pipe 37 is controlled by the pressure discharged from the compressor 1 in such a manner that water flows upon increase of the pressure and stops upon decrease thereof. Other constructional and operational points are the same as in FIG. 3.

Next, in the refrigerating system shown in FIG. 5, an outlet-side pipe 4 of a condenser 3 is connected to a refrigerant inlet side 5A of a receiver tank 5, and defrosting pipe 30 branches from the outlet-side pipe 4 in a position between the condenser 3 and a check valve 39. An auxiliary accumulator 40 is disposed in a low pressure-side pipe 15. In this case, a gas-liquid mixed refrigerant after the removal of rough heat and condensed in the condenser 3 flows into the defrosting pipe 30 and is used for defrosting an evaporator 13. Other constructional and operational points are the same as in FIG. 3.

In each of the above refrigerating systems, a predetermined amount of a refrigerant, e.g. R-22 or R-50, is sealed into the refrigerant circuit, but since the defrosting pipe 30 by-passes the receiver tank 5, the amount of the refrigerant flowing into the receiver tank 5 during defrosting of the evaporator 13 becomes smaller. Particularly, in the refrigerating system of FIG. 5, most of the gas-liquid mixed refrigerant leaving the condenser 3 flows through the defrosting pipe 30, resulting in that the amount of liquid refrigerant staying in the receiver tank 5 during defrosting decreases to an amount of 1 to 2 liters.

However, for cooling the compressor 1 it is necessary to flow a liquid refrigerant through the liquid injection circuit 27 at a rate of 600 cc or so per minute. During defrosting of the evaporator 13, therefore, the liquid refrigerant in the receiver tank 5 will be exhausted in an early stage, with the result that the liquid refrigerant to be fed to the liquid injection circuit 27 becomes short and the temperature of the compressor 1 rises. Since the rise in temperature of the compressor 1 causes damage to the compressor 1, a protective device (not shown) operates to stop the operation of the compressor 1.

Actually, experiments were conducted using a refrigerant sealed in the refrigerating systems in an amount so small as to evolve flash gas in the sight glass 8 portion. As a result, in the refrigerating system of FIG. 5, the head temperature of the compressor 1 during defrosting exceeded +120° C. and the protective device operated to stop the operation of the compressor. Once the operation of the compressor 1 stops, there arises the problem that the defrosting of the evaporator 1 is also discontinued.

Also in the refrigerating system of FIG. 3 or FIG. 4, since the gaseous refrigerant of high temperature and high pressure discharged from the compressor 1 by-passes the receiver tank 5 and flows through the defrosting pipe 30, the amount of the liquid refrigerant flowing through the liquid injection circuit 27 became insufficient, and although the operation of the compressor 1 did not stop, the head temperature of the compressor also exceeded +120° C. In this state, the operation of the compressor became extremely unstable.

For defrosting an evaporator using a gaseous refrigerant of high pressure, there also has been proposed a method of using a gaseous refrigerant after gas-liquid separation in a receiver tank, as disclosed in Japanese Patent Publication No. 20022/74 for example.

SUMMARY OF THE INVENTION

The present invention has been accomplished in view of the above-mentioned prior art and problems of the prior art, and it is the object of the present invention to provide a refrigerating system capable of cooling a compressor stably through a liquid injection circuit even in the case of defrosting an evaporator using a gaseous refrigerant of high pressure.

In one aspect of the present invention there is provided a refrigerating system comprising a compressor having a refrigerant discharge side and a refrigerant suction side; a condenser connected to the discharge side of the compressor; a receiver tank connected to a refrigerant outlet side of the condenser; an evaporator connected between a refrigerant outlet side of the receiver tank and the suction side of the compressor; a defrosting circuit which supplies a gaseous refrigerant obtained by gas-liquid separation in the receiver tank to the evaporator to defrost the evaporator; and a liquid injection circuit which supplies a liquid refrigerant obtained by gas-liquid separation in the receiver tank to a low pressure side in the interior of the compressor.

In another aspect of the present invention there is provided a refrigerating system comprising a compressor having a refrigerant discharge side and a refrigerant suction side; a receiver tank connected to the discharge side of the compressor; a water-cooling pipe for cooling the receiver tank; an evaporator connected between a refrigerant outlet side of the receiver tank and the suction side of the compressor; a defrosting circuit which supplies a gaseous refrigerant obtained by gas-liquid separation in the receiver tank to the evaporator to defrost the evaporator; and a liquid injection circuit which supplies a liquid refrigerant obtained by gas-liquid separation in the receiver tank to a low pressure side in the interior of the compressor.

BRIEF DESCRIPTION OF THE DRAWINGS

The above and other objects, features and advantageous of the present invention will be more apparent from the following description taken in conjunction with the accompanying drawings, in which.

DETAILED DESCRIPTION OF THE PREFERRED EMBODIMENTS

Hereinafter the exemplary embodiments of the present invention will be described in detail with reference to the accompanying drawings.

A refrigerating system in one aspect of the present invention comprises a compressor having a refrigerant discharge side and a refrigerant suction side; a condenser connected to the discharge side of the compressor; a receiver tank connected to a refrigerant outlet side of the condenser; an evaporator connected between a refrigerant outlet side of the receiver tank and the suction side of the compressor; a defrosting circuit which supplies a gaseous refrigerant after gas-liquid separation in the receiver tank to the evaporator to defrost the evaporator; and a liquid injection circuit which supplies a liquid refrigerant after gas-liquid separation in the receiver tank to a low pressure side in the interior of the compressor. In this construction, the whole of the refrigerant which has been discharged from the compressor and condensed in the condenser is once allowed to flow into the receiver tank. Then, at the time of defrosting the evaporator, a gaseous refrigerant after gas-liquid separation in the receiver tank is allowed to flow into the defrosting circuit to effect the defrosting. On the other hand, a liquid refrigerant after gas-liquid separation in the receiver tank stays in the same tank and thus the refrigerant to be fed to the compressor by the liquid injection circuit for cooling the compressor is secured in the receiver tank.

A refrigerating system in another aspect of the present invention comprises a compressor having a refrigerant discharge side and a refrigerant suction side; a receiver tank connected to the discharge side of the compressor; a water-cooling pipe for cooling the receiver tank; an evaporator connected between a refrigerant outlet side of the receiver tank and the suction side of the compressor; a defrosting circuit which supplies a gaseous refrigerant after gas-liquid separation in the receiver tank to the evaporator to defrost the evaporator; and a liquid injection circuit which supplies a liquid refrigerant after gas-liquid separation in the receiver tank to a low pressure side in the compressor. In this construction, the whole of the refrigerant discharged from the compressor is once allowed to flow into the receiver tank. Then, at the time of defrosting the evaporator, a gaseous refrigerant after condensation and gas-liquid separation by the water-cooling pipe in the receiver tank is allowed to flow into the defrosting circuit to effect the defrosting. On the other hand, a liquid refrigerant after gas-liquid separation in the receiver tank stays in the same tank and thus the refrigerant to be fed to the compressor by the liquid injection circuit for cooling the compressor is secured in the receiver tank.

Figure 3:
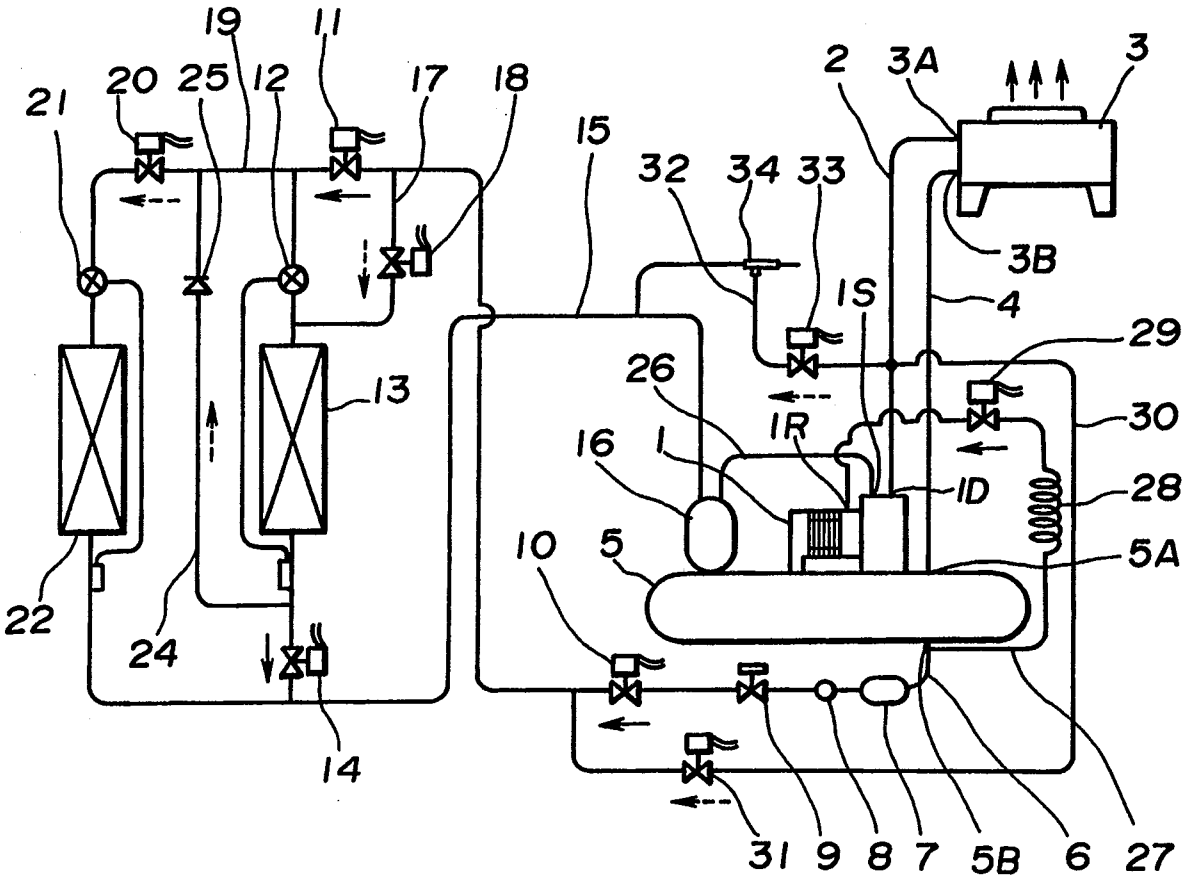
FIG. 3 is a refrigerant circuit diagram of a conventional refrigerating system of the type in which the condensation of a refrigerant is performed by air cooling, and a gaseous refrigerant of high pressure discharged from a compressor is allowed to flow directly into an evaporator during defrosting.

An embodiment of the present invention will be described below with reference to FIG. 1, in which the same reference numerals as in FIG. 3 represent the same portions as in the same figure, so will not be explained here.

Figure 1:
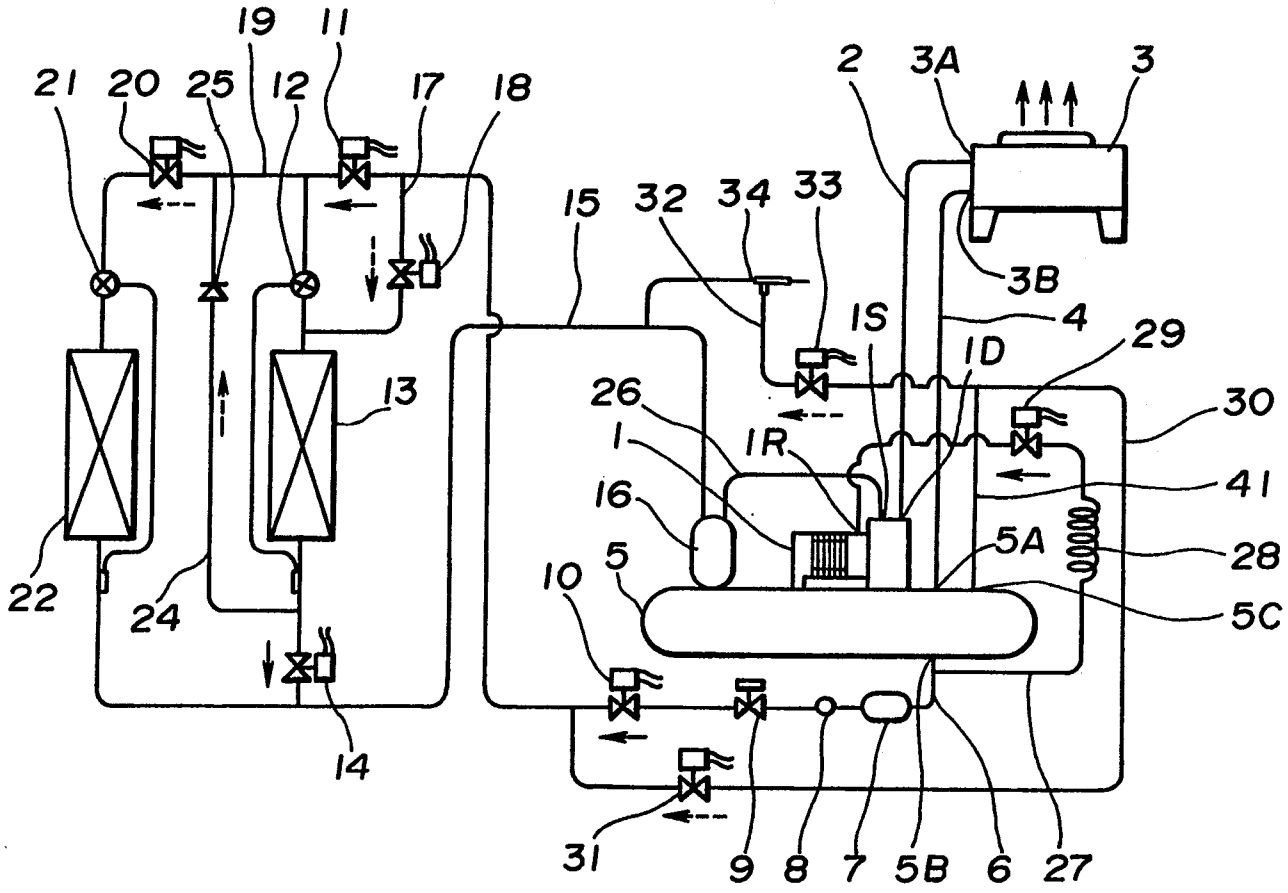
FIG. 1 is a refrigerant circuit diagram of a refrigerating system according to an embodiment of the present invention.

The refrigerating system shown in FIG. 1 and that shown in FIG. 3 are different in that in the refrigerating system of FIG. 3, the defrosting pipes 30 and 32, constituting a defrosting circuit, are branched from the discharge-side pipe 2, whereas in the refrigerating system of FIG. 1, no branch pipe is connected to the discharge-side pipe 2 and the outlet-side pipe 4, but a gaseous refrigerant output 5C is formed in the upper portion of the receiver tank 5, and defrosting pipes 30 and 32 are connected to a pipe 41 which is connected to the gaseous refrigerant outlet 5C. Other constructional points and the foregoing operations of cooling by the evaporator 13, cooling by both evaporators 13 and 22, defrosting of the evaporator 13 and refrigerant recovery are the same as in the refrigerating system of FIG. 3.

In the refrigerating system of FIG. 1, also during defrosting of the evaporator 13 with the solenoid valves 31 and 33 being open, the gaseous refrigerant of high temperature and high pressure discharged from the compressor 1 is condensed in the condenser 3 and thereafter the whole of the refrigerant once flows into the receiver tank 5. A liquid portion of the refrigerant which has thus entered the receiver tank 5 stays in the lower portion of the tank, while a gaseous portion is separated to the upper portion of the tank. The gaseous refrigerant of a relatively low temperature in the receiver tank 5 flows into the defrosting pipe 30 and is used for defrosting the evaporator 13. Further, this gaseous refrigerant flows through the pipe 31 to the low pressure-side pipe 15 to prevent the low pressure-side pressure of the compressor 1 from dropping too much during defrosting. Since the temperature thereof is low in comparison with the high-temperature gas in the refrigerating system of FIG. 3, it is possible to prevent the suction-side temperature of the compressor 1 from becoming too high. Additionally, by connecting the pipe 32 to the pipe 41, it is made possible to aggregate a defrosting circuit together with the defrosting pipe 30.

Thus, since the gaseous refrigerant after gas-liquid separation in the receiver tank 5 is used as a defrosting refrigerant for the evaporator 13, the whole of the refrigerant discharged from the compressor 1 flows into the condenser 3 and the whole of the resulting liquid refrigerant is secured in the receiver tank 5. During defrosting of the evaporator therefore, even if the liquid refrigerant in the receiver tank 5 flows out from the refrigerant outlet side 5B and into the liquid injection circuit 27 and is used for cooling the compressor 1 (with the solenoid valve 10 closed), the liquid refrigerant in the receiver tank 5 will never be exhausted and thus the cooling of the compressor 1 can surely be attained.

Figure 2:
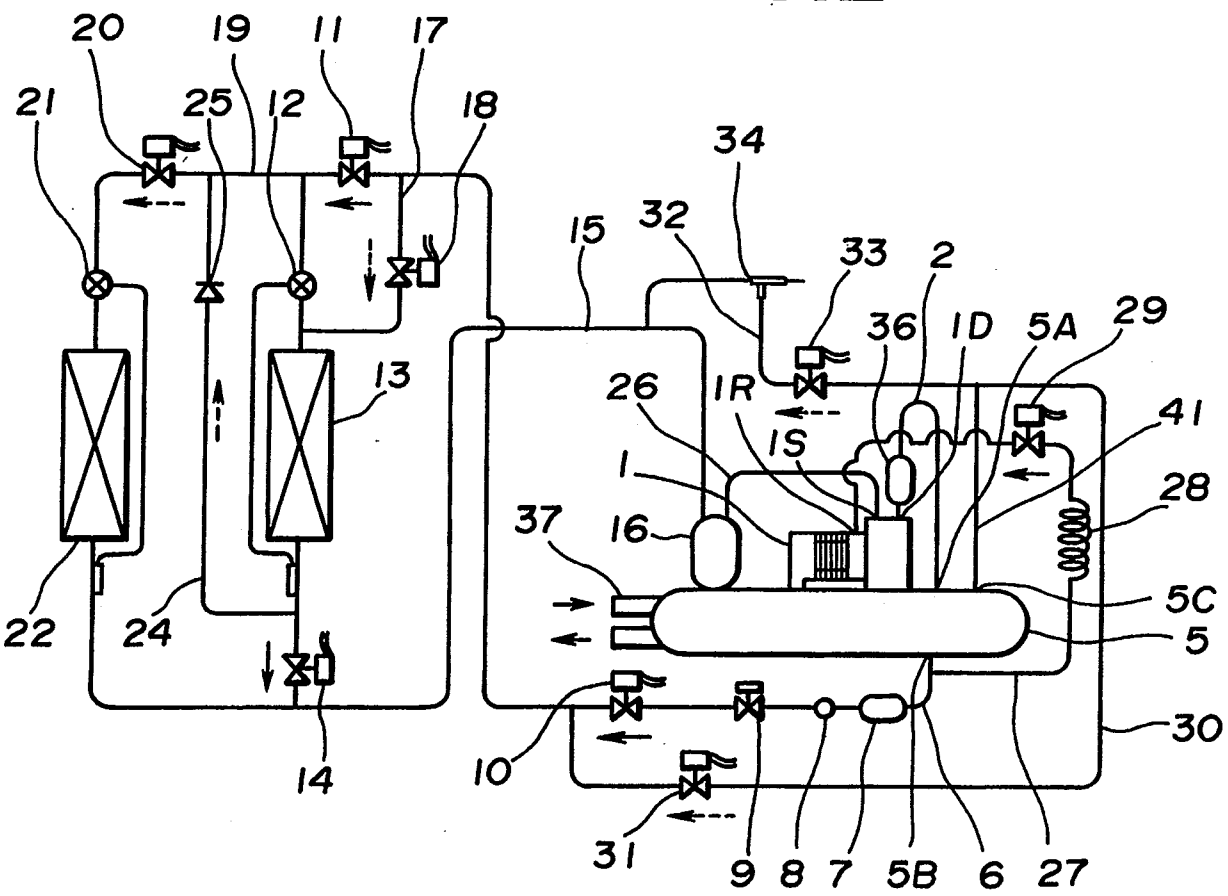
FIG. 2 is a refrigerant circuit diagram of a refrigerating system according to another embodiment of the present invention.
Figure 4:
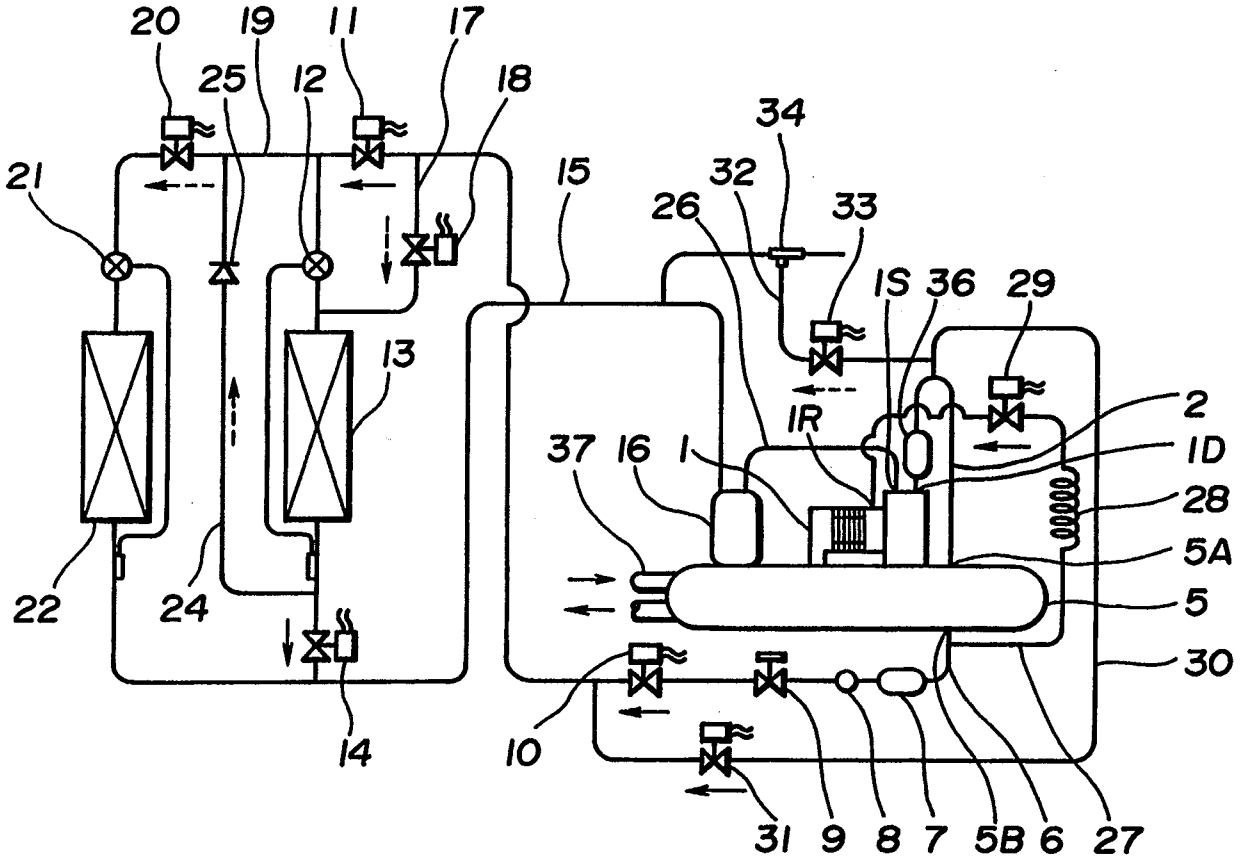
FIG. 4 is a refrigerant circuit diagram of a conventional refrigerating system of the type in which the condensation of a refrigerant is performed by water cooling, and a gaseous refrigerant of high pressure discharged from a compressor is allowed to flow directly into an evaporator during defrosting.
Figure 5:
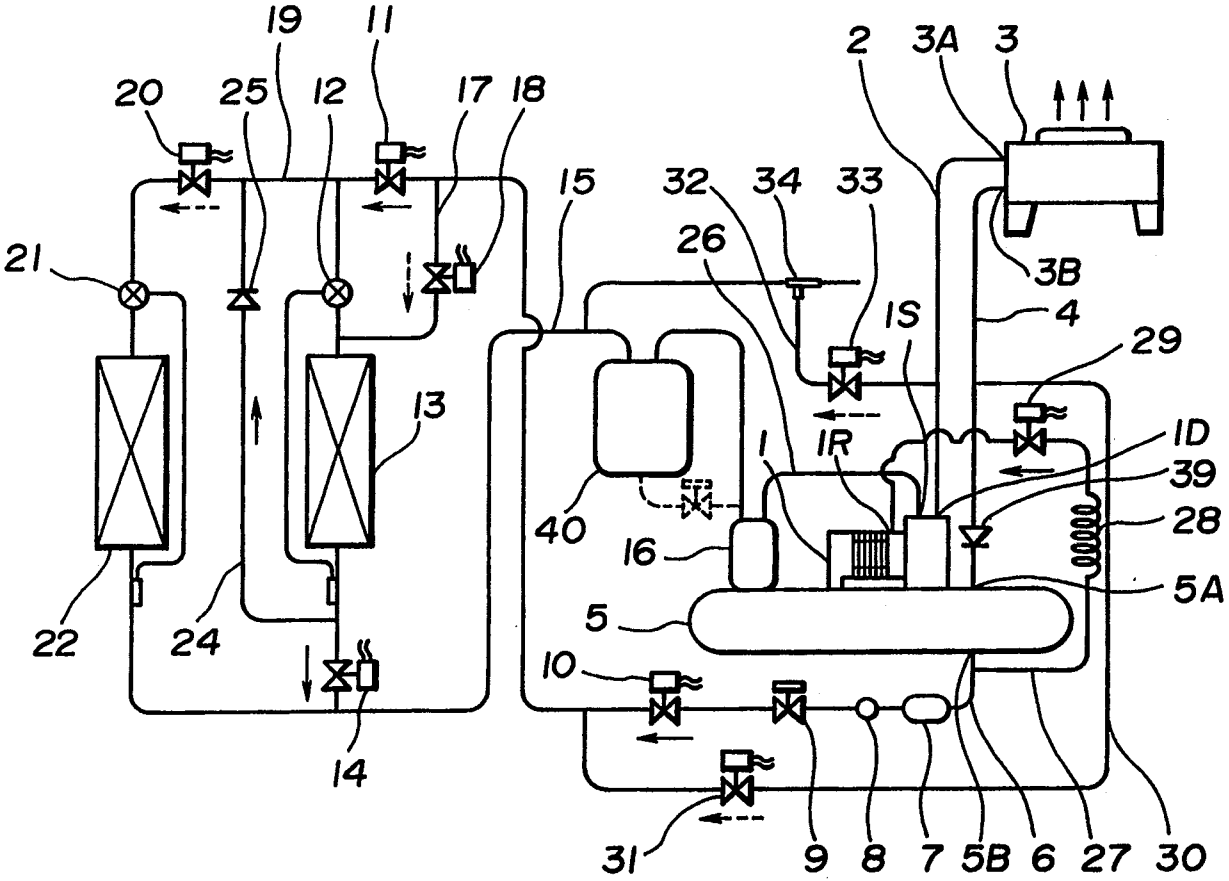
FIG. 5 is a refrigerant circuit diagram of a conventional refrigerating system of the type in which the condensation of a refrigerant is performed by air cooling, and a gas-liquid mixed refrigerant leaving a condenser is allowed to flow into an evaporator during defrosting.

Referring now to FIG. 2, there is illustrated a refrigerant circuit in a refrigerant system according to another embodiment of the present invention, in which the same reference numerals as in FIG. 4 represent the same portions as in the same figure and will not be explained here.

The refrigerating system shown in FIG. 2 and that shown in FIG. 4 are different in that in the refrigerating system of FIG. 4, the defrosting pipes 30 and 32 are branched from the discharge-side pipe 2, whereas in the refrigerating system of FIG. 2, no branch pipe is connected to those pipes, but like the refrigerating system of FIG. 1 a gaseous refrigerant outlet 5C is formed in the upper portion of the receiver tank 5, and defrosting pipes 30 and 32 are connected to a pipe 41 which is connected to the gaseous refrigerant outlet 5C. Other constructional points and the foregoing various operational points are the same as in FIG. 4.

Also in the refrigerating system of FIG. 2, during defrosting of the evaporator 13 with the solenoid valves 31 and 33 being open, the whole of the gaseous refrigerant of high temperature and pressure discharged from the compressor 1 once flows into the receiver tank 5. The refrigerant which has thus entered the receiver tank 5 is condensed by cooling from the water-cooling pipe 37, and the resulting liquid refrigerant stays in the lower portion of the tank, while a gaseous refrigerant is separated to the upper portion of the tank. The gaseous refrigerant of a relatively low temperature in the receiver tank 5 flows into the defrosting pipe 30 and is used to defrost the evaporator 13. This gaseous refrigerant also flows through the pipe 32 into the low pressure-side pipe 15 to prevent the low pressure-side pressure of the compressor from dropping too much during defrosting. Further, since the temperature of this gaseous refrigerant is low in comparison with the gaseous refrigerant of high temperature in the refrigerating system of FIG. 4, it is possible to prevent the suction-side temperature of the compressor 1 from becoming high. Additionally, by connecting the pipe 32 to the pipe 41, it is made possible to aggregate a defrosting circuit together with the defrosting pipe 30.

Like the refrigerating system of FIG. 1, moreover, since the gaseous refrigerant after gas-liquid separation in the receiver tank 5 is used as a defrosting refrigerant for the evaporator 13, the whole of the refrigerant discharged from the compressor 1 flows into the receiver tank 5 and the whole of a liquid refrigerant resulting from condensation therein is secured in the tank 5. During defrosting of the evaporator 13, therefore, even if the liquid refrigerant in the receiver tank 5 flows out from the refrigerant outlet side 5B and into the liquid injection circuit 27 and is used for cooling the compressor 1 (with the solenoid valve 10 closed), the liquid refrigerant in the receiver tank 5 will never be exhausted and thus the cooling of the compressor 1 can surely be attained.

Actually, even when experiments were conducted using a refrigerant sealed in the refrigerating systems so small as to evolve flash gas in the sight glass 8 portion (the refrigerant being R-22 or R-502), the head temperature of the compressor 1 during defrosting was about +116° C. in the refrigerating system of FIG. 1 or FIG. 2, and this temperature was stable, without operation of the protective device, that is, without stopping of the operation of the compressor 1.

Although in the above embodiments the present invention was applied to a showcase for refrigeration and cold storage having evaporators for inner and outer cold air passages, respectively, there is made no limitation thereto. For example, the present invention is also effective as a cooling unit for a freezer-refrigerator or a prefabricated cold storage shed. Further, no limitation is made to the kind of the solvent used and the type of the compressor used.

According to the present invention, as set forth above, a gaseous refrigerant after gas-liquid separation in the receiver tank is used as a defrosting refrigerant for the evaporator, while a liquid refrigerant after gas-liquid separation in the receiver tank is stored in the same tank for cooling the compressor through the liquid injection circuit. Therefore, not only a stable cooling of the compressor can be realized but also defrosting of the evaporator can surely be attained, without exhaustion of the liquid refrigerant to be supplied to the liquid injection circuit even during defrosting of the evaporator.

It is further understood by those skilled in the art that the foregoing description is a preferred embodiment of the disclosed device and that various changes and modifications may be made in the invention without departing from the spirit and scope thereof.

What is claimed is:

1. A refrigerating system containing:

a compressor having a refrigerant discharge side and a refrigerant suction side;

a condenser connected to the discharge side of said compressor;

a receiver connected to a refrigerant outlet side of said condenser to receive and temporarily store refrigerant discharged from the compressor and separate received refrigerant into gas and liquid phases;

an evaporator connected between the refrigerant outlet side of said receiver and the suction side of said compressor;

a gaseous circuit which during defrosting supplies a gaseous refrigerant from said receiver obtained by the gas-liquid separation to both said evaporator to defrost the evaporator and to the compressor refrigerant suction side to prevent an excessive drop of pressure during defrosting; and a liquid injection circuit which during defrosting supplies a liquid refrigerant from said receiver obtained by the gas-liquid separation to a low pressure side in the interior of said compressor to cool said compressor and the compressor refrigerant.

2. A refrigerant system as in claim 1 wherein said gaseous circuit comprises:

an outlet conduit from the part of said receiver having the gaseous phase refrigerant, a first branch conduit connected between said outlet conduit and said evaporator to supply the gaseous phase refrigerant to said evaporator to defrost it, and a second branch conduit connected to said outlet conduit and in fluid communication with the suction side of said compressor to supply the gaseous refrigerant to prevent an excessive drop of pressure during defrosting.

3. A refrigeration system as in claim 2 further comprising:

a valve in said second branch conduit, and means for opening said valve during the defrost portion of the operating cycle.

4. A refrigerating system as in claim 1 wherein the connection from said compressor refrigerant discharge side through said condenser to said receiver is a closed loop without any branches.

5. A refrigerating system comprising:

a compressor having a refrigerant discharge side and a refrigerant suction side;

a receiver connected to the discharge side of said compressor to receive and temporarily store refrigerant discharged from the compressor and separate the received refrigerant into gas and liquid phases;

means for supplying water for cooling said receiver;

an evaporator connected between a refrigerant outlet side of said receiver and the suction side of said compressor;

a gaseous circuit which during defrosting supplies a gaseous refrigerant obtained by gas-liquid separation in said receiver from said receiver to both said evaporator to defrost the evaporator and to the compressor refrigerant suction side to prevent an excessive drop of pressure during defrosting; and a liquid injection circuit which during defrosting supplies a liquid refrigerant obtained by gas-liquid separation in said receiver to a low pressure side in the interior of said compressor to cool said compressor and the compressor refrigerant.

6. A refrigerant system as in claim 5 wherein said gaseous circuit comprises:

an outlet conduit from the part of said receiver having the gaseous phase refrigerant, a first branch conduit connected between said outlet conduit and said evaporator to supply the gaseous phase refrigerant to said evaporator to defrost it, and a second branch conduit connected to said outlet conduit and in fluid communication with the suction side of said compressor to supply the gaseous refrigerant to prevent an excessive drop of pressure during defrosting.

7. A refrigeration system as in claim 6 further comprising:

a valve in said second branch conduit, and means for opening said valve during the defrost portion of the operating cycle.

8. A refrigerating system as in claim 2 wherein the connection from said compressor refrigerant discharge side through said condenser to said receiver is a closed loop without any branches.

* * * * *